US008610525B2

(12) United States Patent
Matsuura et al.

(10) Patent No.: US 8,610,525 B2
(45) Date of Patent: Dec. 17, 2013

(54) LAMINATED INDUCTOR

(75) Inventors: Hitoshi Matsuura, Takasaki (JP); Takayuki Arai, Takasaki (JP); Kenji Otake, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/426,404

(22) Filed: Mar. 21, 2012

(65) Prior Publication Data

US 2013/0033347 A1 Feb. 7, 2013

(30) Foreign Application Priority Data

Aug. 5, 2011 (JP) ..... 2011-171856
Dec. 26, 2011 (JP) ..... 2011-284571

(51) Int. Cl.

| | |
|---|---|
| ***H01F 27/02*** | (2006.01) |
| ***H01F 5/00*** | (2006.01) |
| ***H01F 27/28*** | (2006.01) |
| ***H01F 27/24*** | (2006.01) |

(52) U.S. Cl.
USPC ..... 336/83; 336/200; 336/223; 336/232; 336/233; 336/234

(58) Field of Classification Search
USPC ..... 336/83, 200, 223, 232, 233, 234; 29/602.1, 605, 606
See application file for complete search history.

(56) References Cited

U.S. PATENT DOCUMENTS

| | | | | |
|---|---|---|---|---|
| 4,129,444 | A | 12/1978 | Dreyer et al. | |
| 5,522,946 | A | 6/1996 | Tomita et al. | |
| 6,392,525 | B1 * | 5/2002 | Kato et al. | 336/233 |
| 6,459,351 | B1 * | 10/2002 | Maki et al. | 336/200 |
| 6,764,643 | B2 | 7/2004 | Sagawa et al. | |
| 6,784,782 | B2 | 8/2004 | Inoue et al. | |
| 6,814,928 | B2 | 11/2004 | Sagawa et al. | |
| 7,446,638 | B2 | 11/2008 | Nogi | |
| 8,018,313 | B2 * | 9/2011 | Tada et al. | 336/200 |
| 2004/0140016 | A1 | 7/2004 | Sakamoto et al. | |
| 2004/0209120 | A1 | 10/2004 | Inoue et al. | |
| 2007/0290161 | A1 | 12/2007 | Tokuoka et al. | |
| 2008/0012679 | A1 | 1/2008 | Okabe et al. | |

(Continued)

FOREIGN PATENT DOCUMENTS

| | | |
|---|---|---|
| JP | 07-201570 A | 8/1995 |
| JP | H09-074011 A | 3/1997 |

(Continued)

OTHER PUBLICATIONS

Notice of Reasons for Refusal issued by the Korean Patent Office, mailed on Mar. 1, 2013, for Korean counterpart application No. 10-2012-0012279.

*Primary Examiner* — Elvin G Enad
*Assistant Examiner* — Kazi Hossain
(74) *Attorney, Agent, or Firm* — Law Office of Katsuhiro Arai

(57) ABSTRACT

A laminated inductor having an internal conductive wire forming region, as well as a top cover region and bottom cover region formed in a manner sandwiching the internal conductive wire forming region between top and bottom; wherein the internal conductive wire forming region has a magnetic part formed with soft magnetic alloy grains, as well as helical internal conductive wires embedded in the magnetic part and constituted by a conductor; and at least one of the top cover region and bottom cover region (or preferably both) is/are formed with soft magnetic alloy grains whose constituent elements are of the same types as those of, and whose average grain size is greater than that of, the soft magnetic alloy grains constituting the magnetic part in the internal conductive wire forming region.

12 Claims, 3 Drawing Sheets

(56) References Cited

U.S. PATENT DOCUMENTS

| | | | | |
|---|---|---|---|---|
| 2008/0029300 | A1 | 2/2008 | Harada et al. | |
| 2008/0061264 | A1 | 3/2008 | Maeda et al. | |
| 2008/0152897 | A1 | 6/2008 | Maeda et al. | |
| 2008/0231409 | A1 | 9/2008 | Kugai et al. | |
| 2009/0045905 | A1 | 2/2009 | Nakagawa et al. | |
| 2009/0184794 | A1* | 7/2009 | Tsuzuki | 336/200 |
| 2010/0253463 | A1 | 10/2010 | Shimomura et al. | |
| 2010/0289609 | A1* | 11/2010 | Liao et al. | 336/221 |
| 2011/0024670 | A1 | 2/2011 | Otsuki et al. | |
| 2011/0133881 | A1 | 6/2011 | Nakajima et al. | |
| 2011/0267167 | A1* | 11/2011 | Ogawa et al. | 336/221 |
| 2012/0038449 | A1 | 2/2012 | Ogawa et al. | |

FOREIGN PATENT DOCUMENTS

| | | | |
|---|---|---|---|
| JP | H10-241942 | A1 | 9/1998 |
| JP | 2000-030925 | A | 1/2000 |
| JP | 2000-138120 | A1 | 5/2000 |
| JP | 2001-011563 | A | 1/2001 |
| JP | 2001-118725 | A | 4/2001 |
| JP | 2002-305108 | A | 10/2002 |
| JP | 2002-313620 | A | 10/2002 |
| JP | 2002-343618 | A | 11/2002 |
| JP | 2007-019134 | A | 1/2007 |
| JP | 2007-027354 | A | 2/2007 |
| JP | 2007-123703 | A | 5/2007 |
| JP | 2007-258427 | A | 10/2007 |
| JP | 2007-299871 | A | 11/2007 |
| JP | 2008-028162 | A | 2/2008 |
| JP | 2008-041961 | A | 2/2008 |
| JP | 2008-195986 | A | 8/2008 |
| JP | 2009-088496 | A | 4/2009 |
| JP | 2009-088502 | A | 4/2009 |
| JP | 2011-249774 | A | 12/2011 |
| WO | 2009/128425 | A1 | 10/2009 |
| WO | 2010/013843 | A1 | 2/2010 |

* cited by examiner

LAMINATED INDUCTOR

BACKGROUND

1. Field of the Invention

The present invention relates to a laminated inductor.

2. Description of the Related Art

A method of manufacturing a laminated inductor has been traditionally known, which comprises printing internal conductor patterns on ceramic green sheets containing ferrite, etc., and then stacking the sheets on top of one another and sintering the stacked sheets.

According to Patent Literature 1, through holes are formed at specified positions in a ceramic green sheet made with ferrite powder. Next, on one main side of the sheet in which through holes have been formed, a coil conductor pattern (internal conductor pattern) is printed using a conductive paste in such a way that when a multiple number of the sheets are stacked and their through holes connected, a helical coil will be formed.

Next, the above sheets having through holes and coil conductor pattern formed in/on them are stacked on top of one another according to a specified structure, after which a ceramic green sheet (dummy sheet) having no through holes or coil conductor pattern is stacked on top and bottom. Next, the obtained laminate is pressure-bonded and sintered, and then external electrodes are formed on the end faces where the ends of the coil are led out, to obtain a laminated inductor. Here, a high L value can be achieved by producing the dummy sheet using a material with high magnetic permeability.

There has been a demand of electrical current amplification for laminated inductors (i.e., offering higher rated currents) in recent years, and to meet this demand, changing the type of magnetic material from ferrite as traditionally used, to soft magnetic alloy, is being considered. Proposed soft magnetic alloys such as Fe—Cr—Si alloy and Fe—Al—Si alloy have a higher saturated magnetic flux density compared to conventional ferrite. On the other hand, these materials have a substantially lower volume resistivity compared to conventional ferrite.

PATENT LITERATURES

[Patent Literature 1] Japanese Patent Laid-open No. Hei 10-241942

SUMMARY

On this laminated inductor, the region in which the coil or other conductor pattern is formed can be called the "internal conductive wire forming region," while the regions formed by heat-treating the dummy sheets stacked on the top and bottom of the internal conductive wire forming region can be called the "top cover region" and "bottom cover region," respectively. Under the conventional technology using ferrite, magnetic materials that can be used for the internal conductive wire forming region may be limited for reasons such as compatibility with the conductive material, and therefore attempts are being made to use materials with high magnetic permeability for the top and bottom cover regions whose material can be selected relatively more freely, in order to achieve a higher L value for the device as a whole. With a laminated inductor using ferrite, however, using materials whose magnetic permeability is different means materials of different compositions are bonded together, and this can sometimes cause the constituents of the two materials to mutually diffuse and the characteristics of the materials to deteriorate.

The inventors of the present invention tried to use, for the top and bottom cover regions of a laminated inductor using soft magnetic alloy, a material different from the one used for the internal conductive wire forming region. A laminated inductor using soft magnetic alloy does not undergo characteristic deterioration caused by mutual dispersion of the constituents that occurs with a laminated inductor using ferrite. As a result of the trial, however, it was found that, with a laminated inductor using soft magnetic alloy, use of different materials would achieve only poor bonding between the internal conductive wire forming region and top/bottom cover regions. This is an issue that has not manifested on laminated inductors using ferrite. Also, with the recent trend for smaller devices, internal conductive wires in a laminated inductor are becoming increasingly thinner, and therefore it is necessary to consider designs that prevent the internal conductive wires from shorting or breaking easily.

In light of the above, the object of the present invention is to provide a laminated inductor that uses a soft magnetic alloy as a magnetic material to increase the magnetic permeability and thereby present a high L value, while also supporting smaller devices.

As a result of earnest study, the inventors completed the present invention, which is a laminated inductor having an internal conductive wire forming region, as well as a top cover region and bottom cover region formed in a manner sandwiching the internal conductive wire forming region between a top and bottom. According to the present invention, the internal conductive wire forming region has a magnetic part formed with soft magnetic alloy grains, as well as internal conductive wires embedded in the magnetic part. Also, at least one of the top cover region and bottom cover region, or preferably both, is/are formed with soft magnetic alloy grains whose constituent elements are of the same types as those of, and whose average grain size is greater than that of, the soft magnetic alloy grains constituting the magnetic part in the internal conductive wire forming region.

According to a favorable embodiment of the present invention, the magnetic part in the internal conductive wire forming region, and soft magnetic alloy grains constituting the top cover region and bottom cover region, are all made of a Fe—Cr—Si soft magnetic alloy.

According to the present invention, soft magnetic alloy grains of a large grain size are used for the cover regions, so the magnetic permeability of the device as a whole improves and the L value of the inductor also improves as a result. On the other hand, soft magnetic alloy grains of a small grain size are used for the magnetic part in the internal conductive wire forming region, so the internal conductive wires do not short/break easily and the device can be made smaller as a result. Since the soft magnetic alloy grains for the top and bottom cover regions can be constituted by a soft magnetic alloy whose composition is the same as or similar to that of the soft magnetic alloy grains for the magnetic part in the internal conductive wire forming region, the bonding property of the top and bottom cover regions with the internal conductive wire forming region improves, which in turn helps improve the strength of the device as a whole.

According to a favorable embodiment of the present invention, use of a Fe—Cr—Si alloy for the soft magnetic alloy allows the top and bottom cover regions, and magnetic part in the internal conductive wire forming region, to be made denser and consequently the strength of the laminated inductor as a whole improves.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
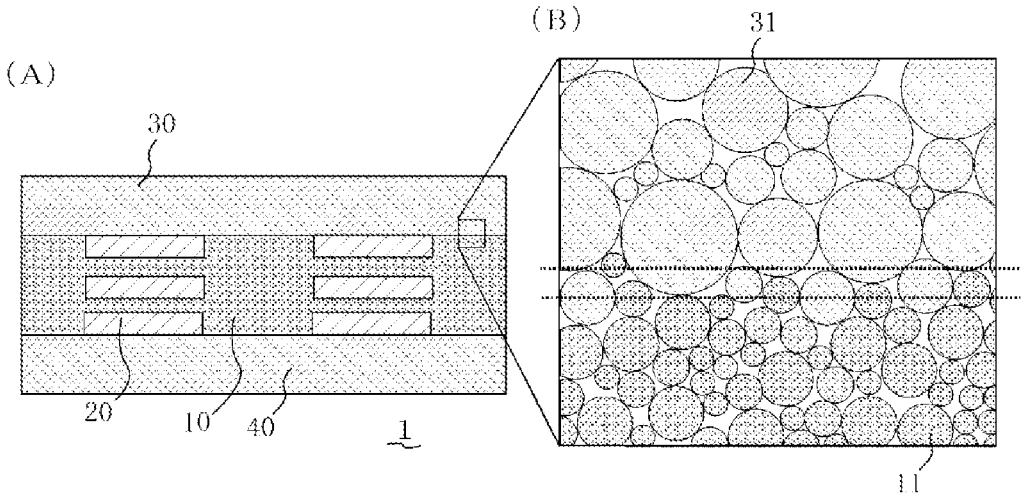
FIG. 1 is a schematic section view of a laminated inductor.

1: Laminated inductor
10: Magnetic part in the internal conductive wire forming region
11: Soft magnetic alloy grain
20: Internal conductive wire
30: Top cover region
31: Soft magnetic alloy grain
40: Bottom cover region.

DETAILED DESCRIPTION

The present invention is described in detail below by referring to the drawings as deemed appropriate. Note, however, that the present invention is not limited to the illustrated embodiment in any way and that, because the drawings may exaggerate the characteristic aspects of the invention, each part of the drawings may not be accurately to scale.

FIG. 1(A) is a schematic section view of a laminated inductor. FIG. 1(B) is an enlarged view of a part of FIG. 1(A). According to the present invention, the laminated inductor 1 has an internal conductive wire forming region 10, 20, as well as top and bottom cover regions 30, 40 sandwiching the internal conductive wire forming region 10, 20 between the top and bottom. The internal conductive wire forming region has a magnetic part 10 and internal conductive wires 20 embedded in this part. The top cover region 30 and bottom cover region 40, in which no internal conductive wires are embedded, are virtually made of a magnetic layer. Under the present invention, the terms "top" and "bottom" indicate directions pertaining to the stacking of one cover layer (top cover layer) 30, internal conductive wire forming region 10, 20, and the other cover layer (bottom cover layer) 40, which are stacked in this order from the top. The terms "top" and "bottom do not limit how the laminated inductor 1 is used or manufactured in any way. So long as there is no difference between the structures of the two cover layers 30, 40, either side can be recognized as the top.

The laminated inductor 1 provided by the present invention has a structure wherein a majority of the internal conductors 20 are embedded in the magnetic material (magnetic part 10). Typically the internal conductive wires 20 are a coil formed in a helical shape, in which case they can be formed by printing a conductor pattern having a near circle, semicircle or other shape on a green sheet by means of screen printing, etc., and then filling a conductor in through holes and stacking the sheets on top of one another. The green sheet on which the conductor pattern is printed contains a magnetic material and has through holes in specified positions. Note that, in addition to forming a helical coil as illustrated, the internal conductive wires may form a spiral coil or they may be meandering conductive wires, straight conductive wires, or the like.

FIG. 1(B) is a schematic enlarged view showing regions near the boundary between the magnetic part 10 in the internal conductive wire forming region and the top cover region 30. In the laminated inductor 1, many soft magnetic alloy grains 11 are put together to constitute the magnetic part 10 of a specified shape. Similarly, many soft magnetic alloy grains 31 are put together to constitute the top cover region 30 of a specified shape. The above is the same as in the bottom cover region 40, although not illustrated in FIG. 1(B). Individual soft magnetic alloy grains 11, 31 have an oxide film formed over roughly their entire peripheries, and this oxide film ensures insulation property of the magnetic part 10 and top and bottom cover regions 30, 40. Preferably this oxide film should be produced through oxidation of the surfaces of soft magnetic alloy grains 11, 31 and their vicinity. In the drawing, the oxide film is not illustrated. The magnetic part 10 having a specified shape, and top and bottom cover regions 30, 40, are generally constituted by soft magnetic alloy grains 11, 31 by means of bonding of the oxide films formed on adjacent grains. Metal parts of adjacent soft magnetic alloy grains 11, 31 may be partially bonded together. Also near the internal conductive wires 20, the soft magnetic alloy grains 11 are adhered to the internal conductive wires 20 primarily via the oxide film. It has been confirmed that, if the soft magnetic alloy grains 11, 31 are made of a Fe—M—Si alloy (where M represents a metal that is oxidized more easily than iron), the oxide film contains at least $Fe_3O_4$ which is a magnetic substance, and $Fe_2O_3$ and MOx (the value of x is determined according to the oxidation number of metal M) which are non-magnetic substances.

Presence of the aforementioned oxide film bonds can be clearly identified by, for example, taking a SEM observation image of approx. 3000 magnifications and visually confirming that the oxide films formed on adjacent soft magnetic alloy grains 11, 31 have the same phase. Presence of oxide film bonds improves the mechanical strength and insulation property of the laminated inductor 1. Although preferably the oxide films formed on adjacent soft magnetic alloy grains 11, 31 should be bonded together over the entire laminated inductor 1, improvement in mechanical strength and insulation property can be achieved correspondingly as long as these bonds are formed at least partially, and therefore this pattern characterized by partial presence of oxide film bonds is considered an embodiment of the present invention.

Similarly, as for the aforementioned bonding of the metal parts of soft magnetic alloy grains 11, 31, presence of such bonds can also be clearly identified by, for example, taking a SEM observation image of approx. 3000 magnifications and visually confirming that adjacent soft magnetic alloy grains 11, 31 have the same phase and also a point of union. Presence of this bonding of soft magnetic alloy grains 11, 31 improves the magnetic permeability further.

It should be noted that a pattern where adjacent soft magnetic alloy grains are simply making a physical contact or positioned near each other without forming any oxide film bond or metal bond can exist locally.

The internal conductive wire forming region of the laminated inductor 1 has the magnetic part 10, and the internal conductive wires 20 which are embedded in the magnetic part 10 and shaped as a helical coil, etc. For the conductor constituting the internal conductive wire 20, any metal normally used for laminated inductors can be used as deemed appropriate, including, but not limited to, silver, silver alloy, etc., for example. Typically both ends of the internal conductive wire 20 are led out, via a lead conductor (not illustrated), respectively, to the opposing end faces on the exterior surface of the laminated inductor 1, and then connected to external terminals (not illustrated).

According to the present invention, the top cover region 30 and bottom cover region 40 sandwich the internal conductive wire forming region 10, 20. The top cover region 30 and bottom cover region 40 are regions, each comprising a layer in which no internal conductive wires are formed. The average grain size of the soft magnetic alloy grains used for at least one of the top cover region 30 and bottom cover region 40 is greater than the average grain size of the soft magnetic alloy grains 11 used for the magnetic part 10 in the internal conductive wire forming region. Preferably both the average grain size of the soft magnetic alloy grains used for the top cover region 30 and average grain size of the soft magnetic alloy grains used for the bottom cover region 40 are greater than the average grain size of the soft magnetic alloy grains 11 used for the magnetic part 10. Also, the soft magnetic alloy grains 11 used for the magnetic part 10 have a composition which is the same as or similar to the composition of the soft magnetic alloy grains used for at least one of, or preferably both, the top cover region 30 and bottom cover region 40. Preferably the types of constituent elements of soft magnetic alloy grains should be the same between at least either the top cover region 30 or bottom cover region 40 and the magnetic part 10 in the internal conductive wire forming region, and more preferably the types and abundance ratios of constituent elements of soft magnetic alloy grains should be the same between at least either the top cover region 30 or bottom cover region 40 and the magnetic part 10 in the internal conductive wire forming region. It is possible that the types of constituent elements of soft magnetic alloy grains are the same between either the top cover region 30 or bottom cover region 40 or both and the magnetic part 10 in the internal conductive wire forming region, while the abundance ratios of constituent elements of soft magnetic alloy grains are different between either the top cover region 30 or bottom cover region 40 or both and the magnetic part 10 in the internal conductive wire forming region. Sameness of the types of constituent elements can be explained by the following example. To be specific, if there are two types of soft magnetic alloys (Fe—Cr—Si soft magnetic alloys), each constituted by three elements of Fe, Cr and Si, then the types of constituent elements are considered the same between these alloys regardless of the abundance ratios of Fe, Cr and Si.

Desirably the average grain size of the soft magnetic alloy grains used for at least one of the top cover region 30 and bottom cover region 40 should be at least 1.3 times, or preferably 1.5 to 7.0 times, the average grain size of the soft magnetic alloy grains 11 used for the magnetic part 10. More preferably both the average grain size of the soft magnetic alloy grains used for the top cover region 30 and average grain size of the soft magnetic alloy grains used for the bottom cover region 40 should be within the above range of values relative to the average grain size of the soft magnetic alloy grains 11 used for the magnetic part 10.

Based on the aforementioned constitution, at least one of the top and bottom cover regions 30, 40 is constituted by large soft magnetic alloy grains, which consequently improves the magnetic permeability. According to the present invention, small soft magnetic alloy grains can be used for the magnetic part 10 in the internal conductive wire forming region. This means that, even when the internal conductive wires 20 become thinner as the device is made smaller, the conductive wires do not break easily. As a result, improved magnetic permeability can be achieved with a smaller device. Particularly when the magnetic part 10 is constituted by soft magnetic alloy grains whose composition is the same as or similar to that of the soft magnetic alloy grains constituting the cover regions 30, 40, the bonding property between the cover regions 30, 40 and magnetic part 10 in the internal conductive wire forming region becomes favorable. In FIG. 1(A), the interface between the top cover region 30 and the magnetic part 10 in the internal conductive wire forming region is clearly distinguishable in terms of materials. In reality, however, the soft magnetic alloy grains 31 for the top cover region 30 and soft magnetic alloy grains 11 for the magnetic part 10 in the internal conductive wire forming region may be mixed together around the bonding interface, as shown in the partially enlarged view in FIG. 1(B). The same can happen near the bonding interface between the bottom cover region 40 and the magnetic part 10 in the internal conductive wire forming region.

The average grain size of soft magnetic alloy grains used for the magnetic part 10 and cover regions 30, 40 is substantially equivalent to and can be indicated by the d50 value which is obtained by taking a SEM image and analyzing the image. To be specific, a SEM image (approx. 3000 magnifications) of a section cutting across the magnetic part 10 and cover regions 30, 40 is taken and at least 300 average-sized grains are selected from the measurement location, and then the region of these grains is measured on the SEM image to calculate the average grain size by assuming that the grains are spherical. Examples of how grains are selected are given below. If fewer than 300 grains are found in the SEM image, all grains in the SEM image are sampled and this process is repeated in multiple locations to select at least 300 grains. If more than 300 grains are present in the SEM image, straight lines are drawn at a specified pitch on the SEM image and all grains on these straight lines are sampled to select at least 300 grains. Alternatively, at least 300 grains contacting the internal conductive wires may be sampled as grains in the internal conductive wire forming region, and at least 300 grains may be sampled from the outermost side as grains in the cover regions. Note that, with a laminated inductor using soft magnetic alloy grains, the grain sizes of material grains are known to be roughly the same as the grain sizes of soft magnetic alloy grains constituting the magnetic part 10 and cover regions 30, 40 after heat treatment. Accordingly, it is possible to assume the average grain size of soft magnetic alloy grains contained in the laminated inductor 1 by measuring the average grain size of soft magnetic alloy grains used as the material.

A typical method of manufacturing a laminated inductor 1 conforming to the present invention is explained below. To manufacture the laminated inductor 1, first a doctor blade, die-coater or other coating machine is used to coat a prepared magnetic paste (slurry) onto the surface of a base film made of resin, etc. The coated film is then dried using a hot-air dryer or other dryer to obtain a green sheet. The magnetic paste contains soft magnetic alloy grains and, typically, a polymer resin as a binder, and solvent.

The soft magnetic alloy grain is primarily made of an alloy and exhibits soft magnetism. An example of the type of this alloy is Fe-M-Si alloy (where M represents a metal that is oxidized more easily than iron). M may be Cr, Al, etc., and should preferably be Cr. For the soft magnetic alloy grains 1, 2, grains manufactured by the atomization method may be used, for example.

If M is Cr, or specifically in the case of a Fe—Cr—Si alloy, the chromium content should preferably be 2 to 8 percent by weight. Presence of chromium is preferred because it creates a passive state when heat-treated to suppress excessive oxidation, while exhibiting strength and insulation resistance. On the other hand, however, the amount of chromium should preferably be kept as small as possible from the viewpoint of improving magnetic characteristics. The aforementioned favorable range is proposed in consideration of these characteristics.

The Si content in a Fe—Cr—Si soft magnetic alloy should preferably be 1.5 to 7 percent by weight. Higher content of Si is preferable because it increases resistance and magnetic permeability, while lower content of Si is associated with good formability. The aforementioned favorable range is proposed in consideration of these characteristics.

The remainder of a Fe—Cr—Si alloy other than Si and Cr should preferably be iron, except for unavoidable impurities. Metals that may be contained in the alloy, other than Fe, Si and Cr, include aluminum, magnesium, calcium, titanium, manganese, cobalt, nickel and copper, among others. Nonmetals that may be contained include phosphorous, sulfur and carbon, among others.

The chemical composition of the alloy constituting each soft magnetic alloy grain in the laminated inductor 1 can be calculated by, for example, capturing a section of the laminated inductor 1 using a scanning electron microscope (SEM) and then applying the ZAF method based on energy dispersive X-ray spectroscopy (EDS).

According to the present invention, preferably the magnetic paste (slurry) for the magnetic part 10 in the internal conductive wire forming region 10 should be manufactured separately from the magnetic paste (slurry) for the top and bottom cover regions 30, 40. Relatively small soft magnetic alloy grains are used to manufacture the magnetic paste (slurry) for the magnetic part 10 in the internal conductive wire forming region, while relatively large soft magnetic alloy grains are used to manufacture the magnetic paste (slurry) for the top and bottom cover regions 30, 40.

As for the grain size of the soft magnetic alloy grain used as the material for the magnetic part 10 in the internal conductive wire forming region, the d50 by volume standard should be preferably 2 to 20 μm, or more preferably 3 to 10 μm. As for the grain size of the soft magnetic alloy grain used as the material for the top and bottom cover regions 30, 40, the d50 by volume standard should be preferably 5 to 30 μm, or more preferably 6 to 20 μm. The d50 of a soft magnetic alloy grain is measured by a grain size/granularity distribution measurement apparatus based on the laser diffraction scattering method (such as Microtrack by Nikkiso). With a laminated inductor 10 using soft magnetic alloy grains, the grain sizes of material soft magnetic alloy grains are known to be roughly the same as the grain sizes of soft magnetic alloy grains 1, 2 constituting the magnetic part 12 of the laminated inductor 10.

Preferably the aforementioned magnetic paste should contain a polymer resin as a binder. The type of this polymer resin is not limited in any way, and examples include polyvinyl butyral (PVB) and other polyvinyl acetal resins, among others. The type of solvent for the magnetic paste is not limited in any way, and examples include butyl carbitol and other glycol ether, among others. The blending ratio of soft magnetic alloy grains, polymer resin, solvent, etc., and other conditions of the magnetic paste can be adjusted as deemed appropriate, and the viscosity and other properties of the magnetic paste can be set through such adjustments.

For the specific method to coat and dry the magnetic paste to obtain a green sheet, any conventional technology can be applied as deemed appropriate.

Next, a stamping machine, laser processing machine or other punch machine is used to punch a green sheet to form through holes in a specified layout. The layout of through holes is set in such a way that, when the sheets are stacked on top of one another, the conductor-filled through holes and conductor pattern will form internal conductive wires 20. For the layout of through holes and shape of conductor patterns used to form internal conductive wires, any conventional technology can be applied as deemed appropriate. In the example section later, a specific example will be explained by referring to the drawings.

Preferably a conductive paste should be used to fill the through holes and also to print the conductor pattern. The conductive paste contains conductive grains and, typically, a polymer resin as a binder, and solvent.

For the conductive grains, silver grains may be used, among others. As for the grain size of the conductive grain, the d50 by volume standard should preferably be 1 to 10 μm. The d50 of the conductive grain is measured using a grain size/granularity distribution measurement apparatus based on the laser diffraction scattering method (such as Microtrack by Nikkiso).

Preferably the conductive paste should contain a polymer resin as a binder. The type of this polymer resin is not limited in any way, and examples include polyvinyl butyral (PVB) and other polyvinyl acetal resins, among others. The type of solvent for the conductive paste is not limited in any way, and examples include butyl carbitol and other glycol ether, among others. The blending ratio of soft magnetic alloy grains, polymer resin, solvent, etc., and other conditions of the conductive paste can be adjusted as deemed appropriate, and the viscosity and other properties of the conductive paste can be set through such adjustments.

Next, a screen printer, gravure printer or other printer is used to print the conductive paste onto the surface of the green sheet, after which the printed sheet is dried using a hot-air dryer or other dryer to form a conductor pattern corresponding to the internal conductive wires. During the printing process, part of the conductive paste is also filled in the through holes. As a result, the conductive paste filled in the through holes, and printed conductor pattern, together constitute the shapes of internal conductive wires.

Using a suction transfer machine and press machine, the printed green sheets are stacked on top of one another in a specified order, and then pressure-bonded under heat to produce a laminate. Next, a dicing machine, laser processing machine or other cutting machine is used to cut the laminate into the size of the component body to produce a before-heat-treatment chip that contains the magnetic part and internal conductive wires that are not yet heat-treated.

A sintering furnace or other heating apparatus is used to heat-treat the before-heat-treatment chip in standard atmosphere or other oxidizing atmosphere. This heat treatment normally includes the binder removal process and oxide film forming process, where the binder removal process is implemented under conditions sufficient to remove the polymer resin used as the binder, such as approx. 300° C. for 1 hour or so, while the oxide film forming process is implemented under the conditions of approx. 750° C. for 2 hours or so, for example.

The before-heat-treatment chip has many fine gaps between individual soft magnetic alloy grains and these fine gaps are normally filled with a mixture of solvent and binder. These fillings are removed in the binder removal process, so by the time the binder removal process is complete, the fine gaps have turned into pores. The chip before heat treatment also has many fine gaps between conductive grains. These fine gaps are filled with a mixture of solvent and binder. These fillings are also removed in the binder removal process.

In the oxide film forming process following the binder removal process, the soft magnetic alloy grains 11, 31 are densely packed to form a magnetic part 10 and top and bottom cover regions 30, 40, and typically when this happens, the surfaces of soft magnetic alloy grains 11, 31 and their vicinity oxidize to form an oxide film on the surfaces of these grains 11, 31. At this time, the conductive grains are sintered to form internal conductive wires 20. As a result, a laminated inductor 1 is obtained.

Normally, external terminals are formed after heat treatment. A dip coater, roller coater or other coating machine is used to coat the prepared conductive paste on both lengthwise ends of the laminated inductor 1, after which the coated inductor is baked using a sintering furnace or other heating apparatus under the conditions of approx. 600° C. for 1 hour or so, for example, to form external terminals. For the conductive paste for the external terminals the aforementioned paste for printing a conductor pattern or any similar paste can be used as deemed appropriate.

EXAMPLE

The present invention is explained more specifically below using examples. Note, however, that the present invention is not at all limited to the embodiments described in these examples.

[Specific Structure of Laminated Inductor]

An example of the specific structure of the laminated inductor 1 manufactured in this example is explained. As a component, the laminated inductor 1 has a length of approx. 3.2 mm, width of approx. 1.6 mm and height of approx. 1.0 mm, and has a rectangular solid shape as a whole.

Figure 2:
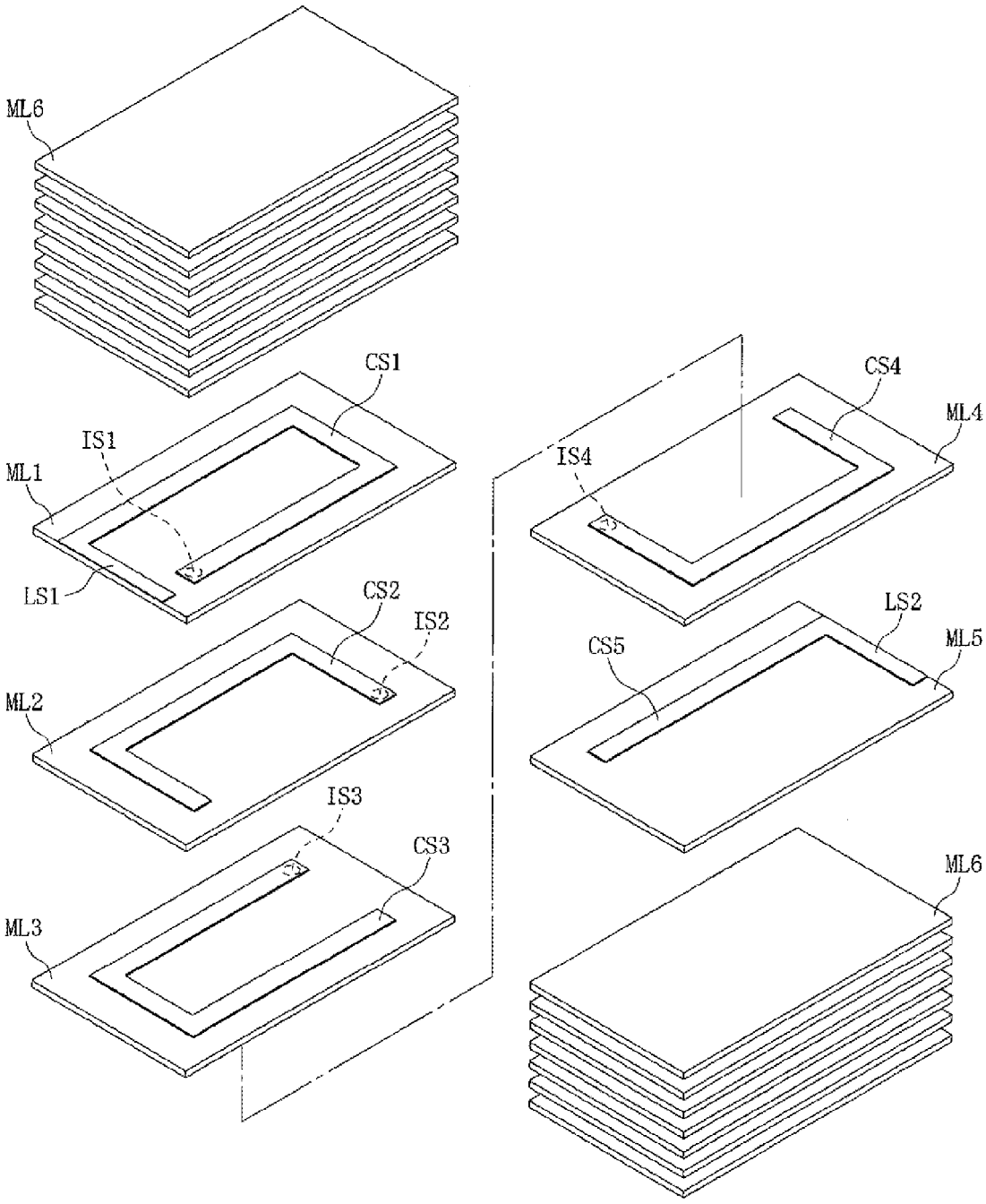
FIG. 2 is a schematic exploded view of a laminated inductor.

FIG. 2 is a schematic exploded view of a laminated inductor. The magnetic part 10 in the internal conductive wire forming region has a structure whereby a total of five magnetic layers ML1 to ML5 are integrated together. The top cover region 30 has a structure whereby eight layers of magnetic layer ML6 are integrated together. The bottom cover region 40 has a structure whereby seven layers of magnetic layer ML6 are integrated together. The laminated inductor 1 has a length of approx. 3.2 mm, width of approx. 1.6 mm and thickness of approx. 30 μm. The magnetic layers ML1 to ML6 each have a length of approx. 3.2 mm, width of approx. 1.6 mm and height of approx. 1.0 mm. The magnetic layers ML1 to ML6 are constituted primarily by soft magnetic ally grains having the compositions and average grain sizes (d50) shown in Table 1, and do not include glass. Also, the inventors of the present invention confirmed, by SEM observation (3000 magnifications), that an oxide film (not illustrated) is present on the surface of each soft magnetic alloy grain and that among the soft magnetic alloy grains in the magnetic part 10 and top and bottom cover regions 30, 40, adjacent alloy grains are mutually bonded together via the oxide films present on them.

The internal conductive wires 20 have a coil structure characterized by a total of five coil segments CS1 to CS5 helically integrated with a total of four relay segments IS1 to IS4 connecting the coil segments CS1 to CS5, where the number of windings is approx. 3.5. These internal conductive wires 20 are obtained primarily by heat-treating silver grains, and the d50 by volume standard of the material silver grain is 5 μm.

The four coil segments CS1 to CS4 have a C shape, while the one coil segment CS5 has a strip shape, and each of the coil segments CS1 to CS5 has a thickness of approx. 20 μm and width of approx. 0.2 mm. The top coil segment CS1 has an L-shaped leader part LS1 formed continuously from the segment for use in connecting to an external terminal, while the bottom coil segment CS5 has an L-shaped leader part LS2 formed continuously from the segment for use in connecting to an external terminal. The relay segments IS1 to IS4 are shaped as columns that pass through the magnetic layers ML1 to ML4, respectively, and each segment has a bore of approx. 15 μm.

Each external terminal (not illustrated) covers each end face in the lengthwise direction, and four side faces near the end face, of the laminated inductor 1, and its thickness is approx. 20 μm. One external terminal connects to the edge of the leader part LS1 on the top coil segment CS1, while the other external terminal connects to the edge of the leader part LS2 on the bottom coil segment CS5. These external terminals were obtained primarily by heat-treating silver grains whose d50 by volume standard was 5 μm.

[Manufacturing of Laminated Inductor]

A magnetic paste constituted by 85 percent by weight of soft magnetic alloy grains, 13 percent by weight of butyl carbitol (solvent) and 2 percent by weight of polyvinyl butyral (binder), as shown in Table 1, was prepared. The magnetic paste for the magnetic layer 10 was prepared separately from the magnetic paste for the top and bottom cover regions 30, 40. A doctor's blade was used to coat this magnetic paste onto the surface of a plastic base film, after which the coated film was dried using a hot-air dryer under the conditions of approx. 80° C. for 5 minutes or so. This way, a green sheet was produced on the base film. Next, the green sheet was cut to obtain first through sixth sheets corresponding to the magnetic layers ML1 to ML6 (refer to FIG. 2), respectively, and also having a size appropriate for forming multiple cavities.

Next, the first sheet corresponding to the magnetic layer ML1 was punched using a punch machine to form through holes in a specified layout corresponding to the relay segment IS1. Similarly, through holes corresponding to the relay segments IS2 to IS4 were formed in specified layouts in the second through fourth sheets corresponding to the magnetic layers ML2 to ML4, respectively.

Next, a printer was used to print a conductive paste, constituted by 85 percent by weight of silver grains, 13 percent by weight of butyl carbitol (solvent) and 2 percent by weight of polyvinyl butyral (binder), onto the surface of the first sheet, after which the printed sheet was dried using a hot-air dryer under the conditions of approx. 80° C. for 5 minutes or so, to produce a first printed layer corresponding to the coil segment CS1 in a specified layout. Similarly, second through fifth printed layers corresponding to the coil segments CS2 to CS5 were produced on the surfaces of the second through fifth sheets in specified layouts, respectively.

The through holes formed on the first through fourth sheets are positioned in a manner overlapping with the ends of the first through fourth printed layers, respectively, and as a result, part of the conductive paste is filled in the through holes when the first through fourth printed layers are printed, to form first through fourth filled portions corresponding to the relay segments IS1 to IS4.

Next, a suction transfer machine and press machine were used to stack, on top of one another in the order shown in FIG. 2, the first through fourth sheets having a printed layer and filled portion, the fifth sheet having only a printed layer, and the sixth sheet having no printed layer or filled portion, and then pressure-bond the stacked sheets under heat, to produce a laminate. This laminate was cut to the size of the component body using a cutting machine, to obtain a chip before heat treatment.

Next, a sintering furnace was used to heat-treat many before-heat-treatment chips, all at once, in a standard atmosphere. First, the chips were heated under the conditions of approx. 300° C. for 1 hour or so as the binder removal process, after which they were heated under the conditions of approx. 750° C. for 2 hours or so as the oxide film forming process. This heat treatment caused the soft magnetic alloy grains to become densely packed to form a magnetic part 10, while the silver grains were sintered to form internal conductive wires 20, and consequently a component body was obtained.

Next, external terminals were formed. The conductive paste constituted by 85 percent by weight of silver grains, 13 percent by weight of butyl carbitol (solvent) and 2 percent by weight of polyvinyl butyral (binder) was applied to both lengthwise ends of the component body using a coater, and the component body was baked in a sintering furnace under the conditions of approx. 800° C. for 1 hour or so. As a result, the solvent and binder were removed, silver grains were sintered, external terminals were formed, and a laminated inductor 1 was obtained.

[Evaluation of Laminated Inductor]

The obtained laminated inductor was evaluated for bonding property between the magnetic part 10 in the internal conductive wire forming region and the top cover region 30. The evaluation method is explained below.

Evaluation was made by observing a side face of the chip, or fractured surface or polished surface of the chip, using an optimal microscope at 100 magnifications.

The guideline for this evaluation is as follows:

○ - - - There is no visible peeling, cracking, etc.

x - - - There is visible peeling, cracking, etc.

The obtained laminated inductor was measured for inductance at 1 MHz using the Impedance Analyzer 4294A by Agilent Technologies. For comparison, a laminated inductor was produced by forming the top cover region 30 and bottom cover region 40 using identical soft magnetic alloy grains used for the magnetic body 10 in the internal conductive wire forming region (hereinafter referred to as "inductor for comparison"), and the inductance of the target laminated inductor was compared with that of the inductor for comparison.

The guideline for this evaluation is as follows:

○ - - - Inductance is higher than that of the inductor for comparison.

Δ - - - Inductance is equivalent to that of the inductor for comparison.

x - - - Inductance is lower than that of the inductor for comparison.

Figure 3:
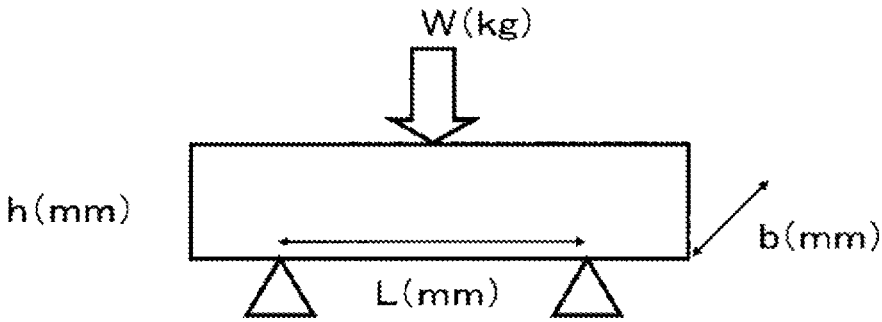
FIG. 3 is a schematic drawing explaining how 3-point bending rupture stress was measured.

The obtained laminated inductor was measured for strength as a device based on 3-point bending rupture stress. FIG. 3 is a schematic drawing explaining how 3-point bending rupture stress was measured. A load was applied to the measurement target as shown, and the load W that caused the measurement target to rupture was measured. The 3-point rupture stress σb was calculated using the formula below by considering the bending moment M and second moment of region I:

$$\sigma b=(M/I)\times(h/2)=3WL/2bh^2$$

For comparison, a laminated inductor was produced by forming the top cover region 30 and bottom cover region 40 using identical soft magnetic alloy grains used for the magnetic body 10 in the internal conductive wire forming region (hereinafter referred to as "inductor for comparison"), and the 3-point bending rupture stress of the target laminated inductor was compared with that of the inductor for comparison.

The guideline for this evaluation is as follows:

○ - - - 3-point bending rupture stress is higher than that of the inductor for comparison.

Δ - - - 3-point bending rupture stress is equal to that of the inductor for comparison.

x - - - 3-point bending rupture stress is lower than that of the inductor for comparison.

The above results were compiled to determine an overall evaluation of the laminated inductor based on the following standard:

○ - - - All of the above three evaluations produced ○.

Δ - - - None of the evaluations produced a ○ or x.

x - - - At least one of the above three evaluations produced x.

The manufacturing conditions and evaluation results of examples and comparative examples are summarized in Table 1. Comparative examples of the present invention are denoted by "*" after the sample number. Samples 1, 5 and 9 are "inductors for comparison" as specified above. In the composition fields of the table, the remainder is all Fe.

TABLE 1

| | Composition of internal conductive wire forming region [wt %] | Grain size in internal conductive wire forming region [μm] | Composition of cover region [wt %] | Grain size in cover region [μm] | Bonding | L value | Strength | Judgment |
|---|---|---|---|---|---|---|---|---|
| 1* | Cr: 4.5, Si: 3.5 | 3.0 | Cr: 4.5, Si: 3.5 | 3.0 | ○ | Δ | Δ | Δ |
| 2 | Cr: 4.5, Si: 3.5 | 3.0 | Cr: 4.5, Si: 3.5 | 6.0 | ○ | ○ | ○ | ○ |
| 3 | Cr: 4.5, Si: 3.5 | 3.0 | Cr: 4.5, Si: 3.5 | 20.0 | ○ | ○ | ○ | ○ |
| 4* | Cr: 4.5, Si: 3.5 | 6.0 | Cr: 4.5, Si: 3.5 | 3.0 | ○ | X | ○ | X |
| 5* | Cr: 4.5, Si: 3.5 | 6.0 | Cr: 4.5, Si: 3.5 | 6.0 | ○ | Δ | Δ | Δ |
| 6 | Cr: 4.5, Si: 3.5 | 6.0 | Cr: 4.5, Si: 3.5 | 20.0 | ○ | ○ | ○ | ○ |
| 7* | Cr: 4.5, Si: 3.5 | 20.0 | Cr: 4.5, Si: 3.5 | 3.0 | ○ | X | ○ | X |
| 8* | Cr: 4.5, Si: 3.5 | 20.0 | Cr: 4.5, Si: 3.5 | 6.0 | ○ | X | ○ | X |
| 9* | Cr: 4.5, Si: 3.5 | 20.0 | Cr: 4.5, Si: 3.5 | 20.0 | ○ | Δ | Δ | Δ |
| 10 | Cr: 4.5, Si: 7.0 | 3.0 | Cr: 4.5, Si: 7.0 | 20.0 | ○ | ○ | ○ | ○ |
| 11 | Cr: 4.5, Si: 7.0 | 6.0 | Cr: 4.5, Si: 7.0 | 20.0 | ○ | ○ | ○ | ○ |
| 12 | Cr: 4.5, Si: 1.5 | 3.0 | Cr: 4.5, Si: 1.5 | 20.0 | ○ | ○ | ○ | ○ |
| 13 | Cr: 4.5, Si: 1.5 | 6.0 | Cr: 4.5, Si: 1.5 | 20.0 | ○ | ○ | ○ | ○ |
| 14 | Cr: 8.0, Si: 3.5 | 3.0 | Cr: 8.0, Si: 3.5 | 20.0 | ○ | ○ | ○ | ○ |
| 15 | Cr: 8.0, Si: 3.5 | 6.0 | Cr: 8.0, Si: 3.5 | 20.0 | ○ | ○ | ○ | ○ |
| 16 | Al: 5.5, Si: 9.5 | 6.0 | Al: 5.5, Si: 9.5 | 20.0 | ○ | ○ | Δ | Δ |
| 17* | Cr: 4.5, Si: 3.5 | 6.0 | Al: 5.5, Si: 9.5 | 6.0 | X | ○ | X | X |
| 18* | Cr: 4.5, Si: 3.5 | 6.0 | Al: 5.5, Si: 9.5 | 20.0 | X | ○ | X | X |
| 19 | Cr: 4.5, Si: 3.5 | 3.0 | Cr: 8.0, Si: 3.5 | 20.0 | ○ | ○ | ○ | ○ |
| 20 | Cr: 8.0, Si: 3.5 | 3.0 | Cr: 4.5, Si: 3.5 | 20.0 | ○ | ○ | ○ | ○ |
| 21 | Cr: 4.5, Si: 3.5 | 3.0 | Cr: 4.5, Si: 7.0 | 20.0 | ○ | ○ | ○ | ○ |

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. In this disclosure, any defined meanings do not necessarily exclude ordinary and customary meanings in some embodiments. Also, in this disclosure, "the invention" or "the present invention" refers to one or more of the embodiments or aspects explicitly, necessarily, or inherently disclosed herein.

The present application claims priority to Japanese Patent Application No. 2011-171856, filed Aug. 5, 2011, and No. 2011-284571, filed Dec. 26, 2011, each disclosure of which is incorporated herein by reference in its entirety. In some embodiments, as the soft magnetic alloy grains, for example, those disclosed in U.S. Patent Application Publication No. 2011/0267167 A1 and No. 2012/0038449, and co-assigned U.S. patent application Ser. No. 13/313,982 can be used, each disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A laminated inductor comprising:

an internal conductive wire forming region comprising a magnetic part formed with soft magnetic alloy grains, as well as internal conductive wires embedded in layers in the magnetic part; and a top cover region and a bottom cover region formed on a top and bottom of and M contact with the internal conductive wire forming region, respectively, to cover the internal conductive wire forming region as top and bottom layers, wherein the top cover region and bottom cover region are constituted by a magnetic body without internal conductive wires, and at least one of the top cover region and bottom cover region is formed with soft magnetic alloy grains whose constituent elements are substantially the same as those of the soft magnetic alloy grains constituting the magnetic part in the internal conductive wire forming region, wherein average-sized soft magnetic alloy grains constituting the at least one of the top cover region and bottom cover region are larger than average-sized soft magnetic alloy grains constituting the magnetic part in the internal conductive wire forming region.

2. A laminated inductor according to claim 1, wherein the top cover region and bottom cover region are both formed with soft magnetic alloy grains whose constituent elements are of the same types as those of, and whose average grain size is greater than that of, the soft magnetic alloy grains constituting the magnetic part in the internal conductive wire forming region.

3. A laminated inductor according to claim 1, wherein the soft magnetic alloy grains constituting the magnetic part in the internal conductive wire forming region and soft magnetic alloy grains constituting the top cover region and bottom cover region are all made of a Fe—Cr—Si soft magnetic alloy.

4. A laminated inductor according to claim 2, wherein the soft magnetic alloy grains constituting the magnetic part in the internal conductive wire forming region and soft magnetic alloy grains constituting the top cover region and bottom cover region are all made of a Fe—Cr—Si soft magnetic alloy.

5. A laminated inductor according to claim 1, wherein the average grain size of the soft magnetic alloy grains used for at least one of the top cover region and bottom cover region is about 1.5 times to about 7.0 times the average grain size of the soft magnetic alloy grains used for the magnetic part.

6. A laminated inductor according to claim 1, wherein the soft magnetic alloy grains used for the magnetic part have a d50 by volume standard of about 2 μm to about 20 μm, and the soft magnetic alloy grains used for at least one of the top and bottom cover regions have a d50 by volume standard of about 5 μm to about 30 μm.

7. A laminated inductor according to claim 1, wherein the internal conductive wire forming region and the top and bottom cover regions are heat-treated simultaneously.

8. A laminated inductor according to claim 1, wherein the soft magnetic alloy grains constituting the at least one of the top cover region and bottom cover region have substantially the same compositions as the soft magnetic alloy gains constituting the magnetic part in the internal conductive wire forming region.

9. A laminated inductor according to claim 1, wherein the soft magnetic alloy grains constituting the magnetic part, the top cover region, and bottom cover region have oxide film formed on their surfaces.

10. A laminated inductor according to claim 1, wherein the grain size of the average-sized soft magnetic alloy grains constituting the at least one of the top cover region and bottom cover region is at least 1.3 times greater than that of the average-sized soft magnetic alloy grains constituting the magnetic part in the internal conductive wire forming region.

11. A laminated inductor according to claim 1, wherein the grain size of the average-sized soft magnetic alloy grains constituting the at least one of the top cover region and bottom cover region and the grain size of the average-sized soft magnetic alloy grains constituting the magnetic part in the internal conductive wire forming region are measured using a SEM image of a cross section of each region, wherein the average grain size of at least 300 adjacent grains included in a given region of the SEM image of each region is measured as the grain size of the average-sized soft magnetic alloy grains of each region.

12. A laminated inductor according to claim 1, wherein at least one of the top cover region and bottom cover region is constituted by multiple magnetic layers integrated together, and the internal conductive wire forming region is constituted by multiple magnetic layers with coil structures integrated together.

* * * * *